US006047483A

United States Patent [19]

Allison et al.

[11] Patent Number: 6,047,483

[45] Date of Patent: Apr. 11, 2000

[54] HEATING SYSTEM FOR COMPRESSIVE SHRINKAGE MACHINES

[75] Inventors: Earl S. Allison, Kannapolis; Gavin B. Rumble, Lexington; Robert J. Hughes, Lexington; Barry D. Miller, Lexington, all of N.C.

[73] Assignee: Tubular Textile LLC, Atlanta, Ga.

[21] Appl. No.: 09/208,231

[22] Filed: Dec. 9, 1998

Related U.S. Application Data

[60] Provisional application No. 60/069,376, Dec. 12, 1997.

[51] Int. Cl.[7] ..... D06F 58/00

[52] U.S. Cl. ..... 34/128; 34/129; 34/146; 26/18.6; 26/18.5; 165/89

[58] Field of Search ..... 34/110, 118, 126, 34/128, 129, 146; 26/18.6, 18.5, 99; 100/162 B, 329, 334; 162/111, 206, 207, 200, 281, 361; 165/89

[56] References Cited

U.S. PATENT DOCUMENTS

| | | | |
|---|---|---|---|
| 2,867,414 | 1/1959 | Maloney, Jr. et al. | 165/89 |
| 3,006,610 | 10/1961 | Siegel | 165/89 |
| 3,186,108 | 6/1965 | Clark | 34/146 |
| 3,241,147 | 3/1966 | Baker | 34/146 |
| 4,041,614 | 8/1977 | Robinet | 34/128 X |
| 4,155,177 | 5/1979 | Justus | 165/89 X |
| 5,016,329 | 5/1991 | Milligan et al. | 26/18.5 |
| 5,228,214 | 7/1993 | Biancalani et al. | 34/129 X |
| 5,655,275 | 8/1997 | Allison et al. | 26/18.6 |
| 5,722,183 | 3/1998 | Orloff et al. | 34/146 X |

*Primary Examiner*—Stephen Gravini
*Attorney, Agent, or Firm*—Schweitzer Cornman Gross & Bondell LLP

[57] ABSTRACT

A heating system for a mechanical compressive shrinkage apparatus in which a continuously flowing liquid heat exchange medium is caused to flow in series through each of the components required to be heated. Heat is input to the flowing medium in accordance with the temperature of one of the components to be heated, preferably the first in the series. Uniformity and constancy of both absolute and relative temperatures of the series-connected components is achieved. A mixture of water and propylene glycol alcohol is an advantageous heat exchange medium for the purpose, which allows operation at lower pressure without the maintenance problems of a system using, for example, oil as the exchange medium.

8 Claims, 3 Drawing Sheets

HEATING SYSTEM FOR COMPRESSIVE SHRINKAGE MACHINES

This application claims priority of provisional application Ser. No. 60/069,376, filed Dec. 12, 1997.

BACKGROUND AND SUMMARY OF THE INVENTION

In the processing of various fabrics, particularly including but not limited to tubular and open width knitted fabrics, an integral part of many finishing operations performed on the fabric, to ready the fabric for cutting into garment sections, is the performance of lengthwise compressive shrinkage operations for stabilization of the fabric geometry. Knitted fabrics in particular, because of their construction, tend to be somewhat geometrically unstable. During normal processing of the fabric, to prepare it for the manufacture of garments, the fabric frequently is wet and under longitudinal tension. As a result, the fabric tends to become elongated lengthwise and narrowed widthwise. Accordingly, as a final step in the process of finishing the fabric and making it ready for cutting into garments, the fabric typically is laterally distended to a predetermined width, and then subjected to one or more mechanical compressive shrinkage operations in the lengthwise direction, such that the fabric, when later cut and sewn into garments, does not undergo significant dimensional change when worn and laundered.

Equipment for mechanical compressive shrinkage of knitted fabrics is in general known. A particularly advantageous form of apparatus for such purpose is described in the Milligan U.S. Pat. No. 4,882,819, owned by Tubular Textile Machinery. This equipment comprises a pair of controllably driven rollers, one a feed roller and the other a retarding roller. An arcuate shoe is associated with the feed roller and forms a confined path to guide fabric, being advanced by the feed roller, toward and into a compressive shrinkage zone formed by opposed blades projecting between the feed and retarding roller. The blades define a short, confined path for guiding the fabric as it traverses from the surface of the feed roller to the surface of the retarding roller. The retarding roller is driven to have a surface speed slightly less than that of the feed roller, so that the fabric is controllably compacted in a lengthwise direction, principally in the short confined path defined by the opposed blades.

Compressive shrinkage equipment of the general type described above must be manufactured, maintained and operated with very fine, accurately controlled clearances. Particularly in machines designed to process wide fabrics, maintaining of the necessary fine tolerances during operations has presented problems, partly because of the necessity for operating the equipment with the active components at significantly elevated temperatures. In the past, for heating the feed roll, it has been common to utilize steam, directed internally of the feed roll. For heating of the upper shoe and the blade associated therewith, it has been common to utilize electrical heating elements, such as Calrods. Both the steam and the electrical heating arrangements have significant shortcomings, in that it is necessary to cycle on and off the flow of steam and the flow of electrical energy, in order to avoid overheating of the components. This tends to result in an excessive cycling of the component temperatures between upper and lower limits, causing undesirable variations in the expansion and contraction of the components. Additionally, when it is necessary to stop the machinery for changing of a fabric batch or for other reason, it is typically necessary to shut off the flow of steam to the feed roll altogether, and this can result in condensation forming within the hollow interior of the feed roll. As a result, there can be a substantial difference in temperature between the bottom and the top of the roll, which may cause bowing of the roll for a period of time when the equipment is restarted. This can result in interference and damage to the finely adjusted components.

Several steps have been taken in an effort to overcome the disadvantages of utilizing steam for heating of the feed roll. One of these is the utilization of circulating hot oil, which is heated remotely from the feed roller, by means of a steam-heated heat exchanger. A system of this type minimizes cycling and eliminates the problems that otherwise arose from the condensation of steam during down periods. The use of circulating oil, however, has important disadvantages. With any fluid system it is necessary to utilize rotary joints to supply the medium to a rotating roller, and such joints can sometimes be a source of leakage. More importantly, perhaps, it is necessary from time to time to service and/or exchange the feed rollers, and at such times a circulating oil system is messy and difficult to deal with, particularly in an environment in which cleanliness of the equipment is important so as not to stain the fabric being processed.

Attempts have also been made to utilize heated water, instead of oil, circulating through the feed roller and heated externally thereof by a steam-fed heat exchanger. While this solved certain problems encountered with the circulation of heated oil through the feed roller, it is necessary, in order to achieve desired levels of operating temperatures over a wide range of production operations, to maintain the circulating water under significantly elevated pressure, as much as 40 to 50 psi in order to operate at desired temperatures. Additionally, both the oil and water systems retained the known electrical heating arrangements for the upper shoe assembly.

Pursuant to the invention, a novel and improved heating system is provided for a mechanical compressive shrinkage apparatus, in which a circulating liquid medium is employed, circulating in series through a plurality of components required to be heated, including the upper shoe assembly, the feed roller and a lower shoe assembly which mounts the lower blade element. Significant advantages are derived from flowing the fluid medium in series through these several components.

By directing flow of the heating medium in series, preferably through the upper shoe first, then the feed roller and finally the lower shoe, all of these precisely adjusted and mechanically cooperating elements of the compactor station are maintained in a steady and uniform temperature relationship while the equipment is in operation, and also while it is stopped. The equipment can be started from a cold condition more easily and reliably, and also more easily restarted from a temporarily stopped condition. By reliably assuring controlled and uniform heating of the several components, it is significantly less likely that expensive, precision components will be damaged by reason of temporary thermal distortions.

Pursuant to another aspect of the invention, the heated liquid medium is in the form of a mixture of water and a harmless "anti-freeze" additive, such as propylene glycol alcohol (PGA), which enables the system to operate throughout the desired temperature ranges without requiring excessive pressures to be employed. For example, with a mixture of about 70% water and 30% PGA, the liquid medium may be heated to temperatures of 230° F. at pressures on the order of 15–30 psi, a much more easily handled pressure level than with water alone, which would involve 40–50 psi. Unlike the circulating hot oil, moreover, the water/PGA mixture does not present a significant cleanup problem when machine maintenance is required.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 3:
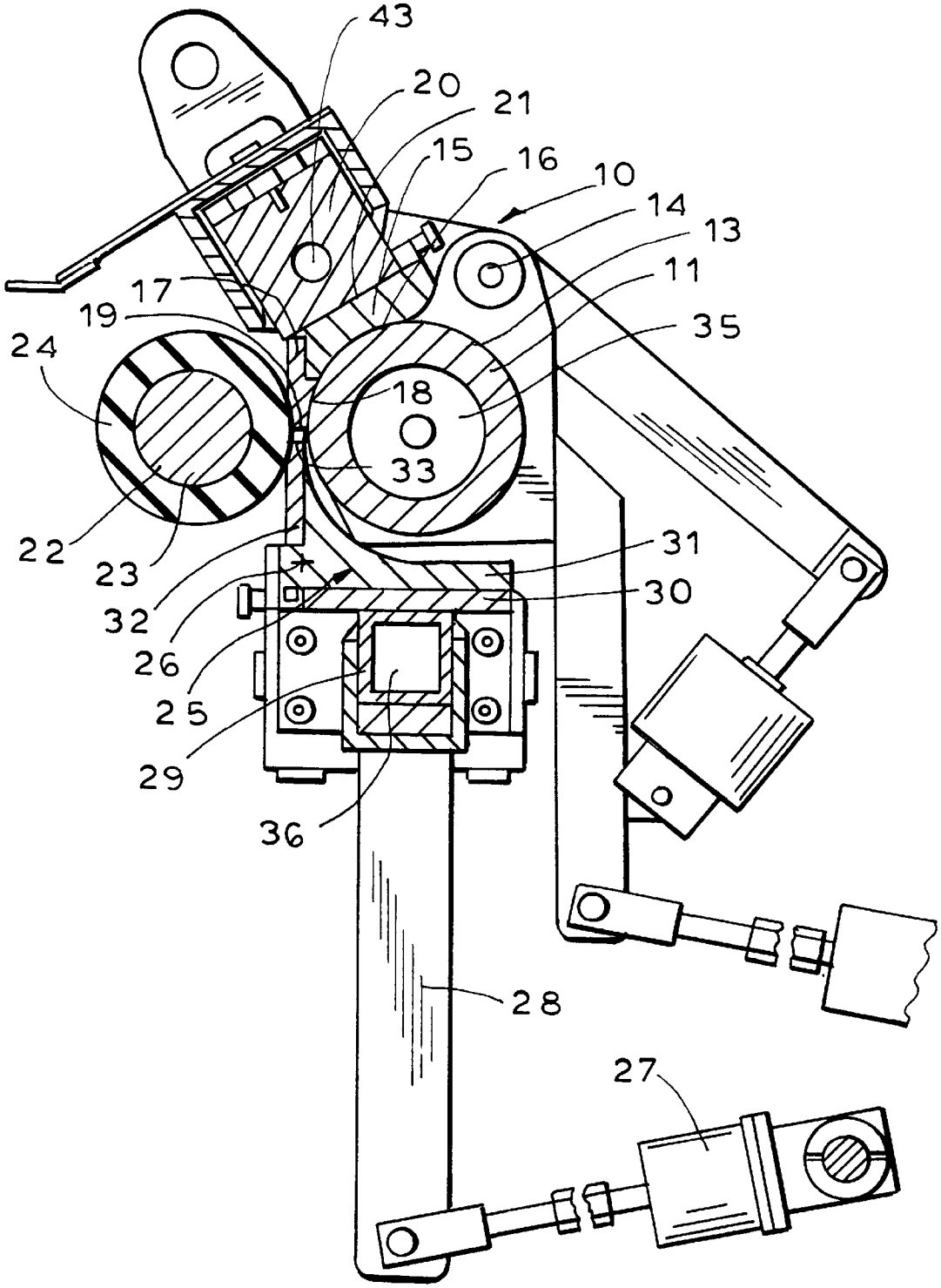
FIG. 3 is a cross sectional view as taken generally on line 3—3 of FIG. 2.

Referring now to the drawings, and initially to FIG. 3 thereof, there are illustrated essential elements of a compacting station of a compressive shrinkage apparatus according to the before mentioned Milligan U.S. Pat. No. 4,882,819, referred to commercially as Pak-Nit II, marketed by Tubular Textile Machinery, of Lexington, N.C. The compacting station, generally indicated by the reference numeral 10 comprises a feed roller 11, which is in the form of a hollow steel cylinder mounted at each end in fixed bearing supports 12 and typically provided with a textured outer surface 13 to provide a surface grip with fabric to be processed.

Mounted on a pivot 14 is an upper shoe assembly comprising a main shoe 15 formed with an arcuate lower surface 16 conforming with the cylindrical outer surface 13 of the feed roller and defining therewith a guided entry path for the infeed of fabric to be processed. At its discharge end, the shoe 15 mounts an upper compacting blade 17 having an arcuate surface 18 forming a continuation of the arcuate surface 16 of the shoe and having an end surface 19 forming part of a short compacting zone.

A heavy metal shoe support bar 20, preferably of square cross section, extends across the full width of the machine and rigidly mounts the upper shoe 15, which may be constructed of a plurality of segments, aligned end-to-end to form an effectively continuous shoe structure. Both the support bar 20 and the shoe elements 15 have broad confronting surfaces in intimate contact, as indicated at 21 in FIG. 3. Similarly, there is substantial surface contact between the shoe elements 15 and the blade 17. The arrangement is such as to provide for effective heat transfer throughout the components of the upper shoe assembly.

Mounted in parallel relation to the feed roller 11 is a retarding roller 22, typically comprising a metal core 23 and a resilient surface covering 24. The retarding roller is mounted for controlled movement toward and away from the feed roller 11, and has a working position generally as shown in FIG. 3 spaced slightly away from the feed roller, with the upper compacting blade 17 extending between the feeding and retarding rollers, substantially to the level of a plane passing through the axes of the respective rollers.

The retarding roller 22 is mounted by suitable means (not shown) for controlled movement toward and away from the working position shown in FIG. 3. Reference may be made to the Allison et al. U.S. Pat. No. 5,655,275, assigned to Tubular Textile LLC, for further details on the mounting and actuating arrangements for the various component parts of the compacting station.

A lower shoe assembly, generally designated by the reference numeral 25, is pivoted for movement about an axis 26, under the control of an actuator 27 and lever 28 at each end of the assembly. The lower shoe assembly 25 includes a tubular structural element 29 and mounting plate 30, which extend the full width of the machine, and a lower shoe 31 which may be comprised of a plurality of shoe segments arranged end-to-end extending across the width of the machine. A lower compacting blade 32 is mounted on the lower shoe 31 and extends upward between the feeding and retarding rollers 11, 22. The lower blade has an end surface 33 which confronts and is spaced a short distance from the corresponding end surface 19 of the upper blade, and these surfaces define a short, confined path for fabric as it transfers from the feed roller 11 to the retarding roller 22.

In typical operation of the compressive shrinkage equipment shown in FIG. 3, a processed fabric (not shown but typically a tubular or open width knitted fabric) is initially distended to a predetermined width and steamed and then directed immediately into a feed path between the surface 13 of the feed roller 11 and the conforming surface 16 of the upper shoe 15. The fabric advances at the surface speed of the feed roller 11 until it reaches the path defined by the confronting surfaces 19, 33 of the respective upper and lower compacting blades 17, 32, at which time it is diverted through that path and into contact with the surface 24 of the retarding roller 22 travelling at a controllably slower surface speed. Compressive shrinkage of the fabric takes place in a known manner, as a result of the deceleration of the fabric, while being confined between the confronting faces of the compacting blades 17, 32.

It has long been known that proper heating of the working components of the compressive shrinkage equipment is important to the proper performance of the compressive shrinkage operation, and the various before-described approaches have been utilized to achieve the necessary heating. However, as the equipment has become larger, and efforts have been made to maintain finer tolerances and controls, the shortcomings of existing heating systems have become more serious and more detrimental to the performance of the equipment. The system of the present invention addresses the problems of existing systems by utilizing a single heating medium, in the form of a continuously flowing liquid heat exchange medium, for controlling the temperature of all of the heated components of the apparatus. After being heated remotely, the liquid heat exchange medium is caused to flow continuously and in series through all of the several major components of the equipment which are required to be heated. The operating temperature of the equipment is sensed at a preselected point on the apparatus, and heat is added to the circulating medium as necessary, under the control of this sensor. Because the liquid heat exchange medium is flowing in series through the several components, the temperatures of all of them are at all times maintained in a close and predetermined relationship, so that distortions of critically adjusted components are minimized. This enables a higher quality of output to be achieved and minimizes maintenance costs as well.

Figure 1:
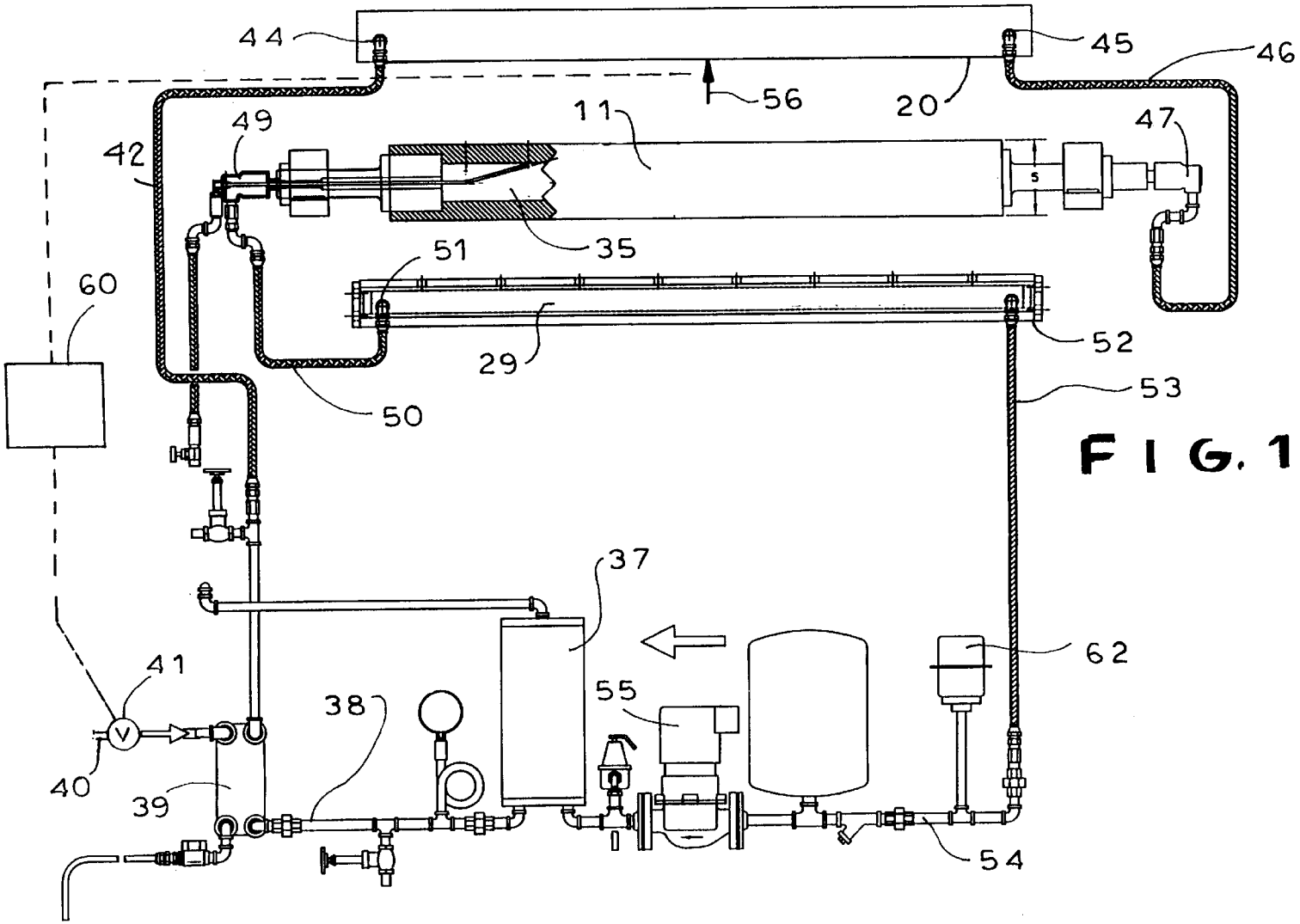
FIG. 1 is simplified schematic flow diagram illustrating a preferred system according to the invention for heating of the critical components of a two-roller, two-blade compressive shrinkage machine.
Figure 2:
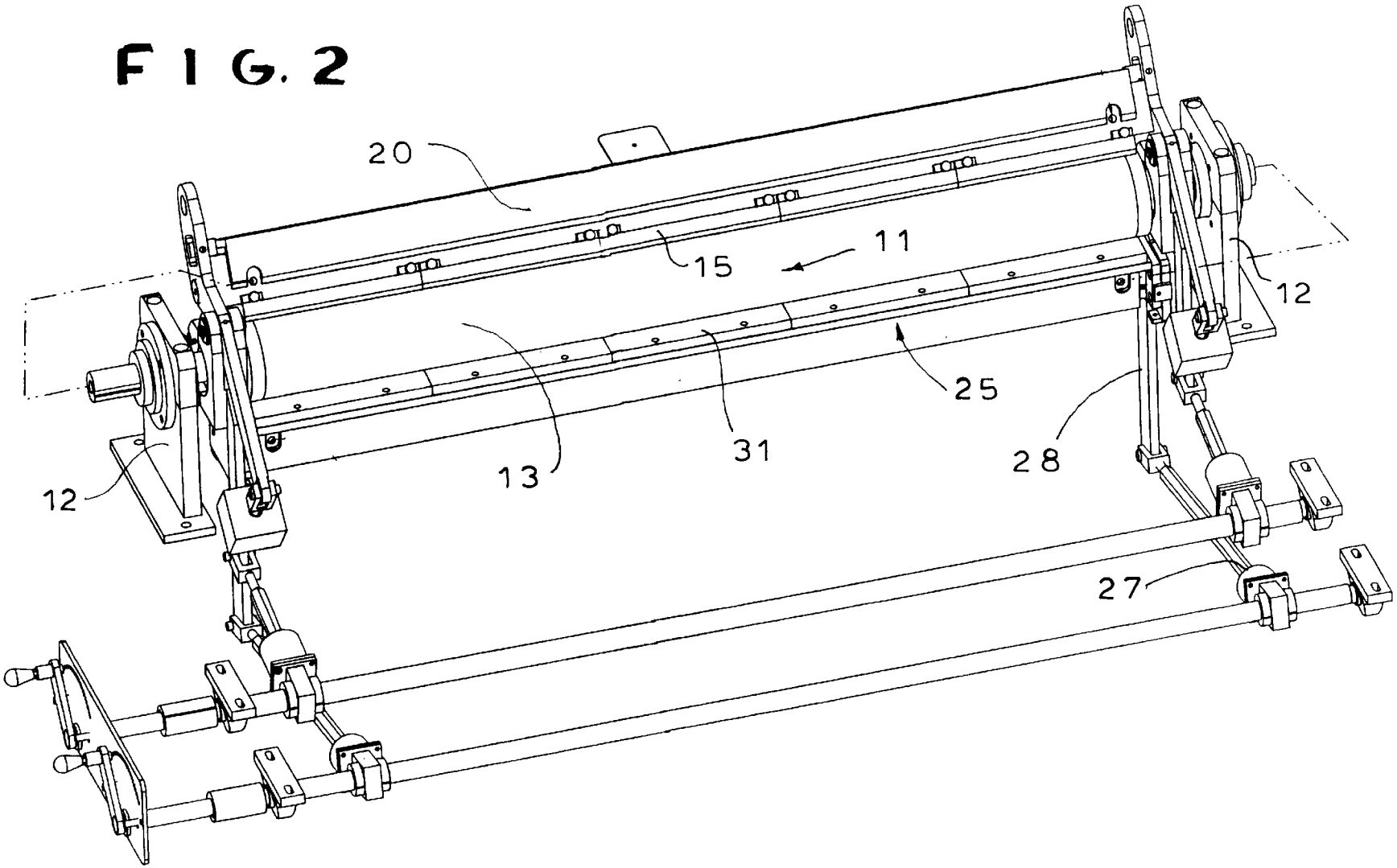
FIG. 2 is a perspective illustration showing selected components of the compressive shrinkage machine illustrated schematically in FIG. 1.

With reference to FIG. 1 of the drawing, there is shown schematically a system according to one preferred embodiment of the invention by which a liquid heat exchange medium is flowed in series, initially through the upper shoe support bar 20 forming part of the upper shoe assembly, and then through the hollow interior 35 of the feed roller, and thence through the hollow interior 36 of the tubular structural element 29 forming part of the lower shoe assembly 25. In the system illustrated in FIG. 1, a supply of the fluid medium is held in a reservoir 37 connected through piping 38 to an indirect heat exchanger 39 supplied with steam from a plant source 40 through a control valve 41. Heated fluid medium from the heat exchanges 39 is directed through a flexible hose 42 into one end of the support bar 20. The bar 20 has been provided with an internal passage 43 (FIG. 3) which extends generally throughout the entire length of the bar, from an inlet opening 44 at one end to an outlet opening 45 at the opposite side. Preferably, the passage 43 is located at or near the center of mass of the upper shoe assembly, comprising the support bar 20, the upper shoe 15 and the upper compacting blade 17, for optimum distribution of heat throughout the assembly.

Heat exchange medium exiting the support bar 20 at the outlet 45 flows through a flexible hose 46 and rotary connection 47 into the hollow interior 35 (FIG. 3) of the feed roller 11. The liquid medium flows from one end to the other of the feed roller and exits through a rotary connection 49. From the rotary connection 49, the heat exchange medium flows through a flexible hose 50 and into the interior 36 of the tubular structural element 29. The tubular element 29 is closed at both ends and provided with inlet and outlet openings 51, 52 respectively, as shown in FIG. 1. From the outlet opening 52, the heat exchange medium flows through a flexible hose 53 and piping 54 to a circulation pump 55 connected to the reservoir 37.

In the system of the invention, the circulating pump 55 is in continuous operation when the equipment is functioning or when the equipment is temporarily stopped. Control of the temperature of the circulating heat exchange medium is maintained by means of a thermocouple or other temperature sensing means 56 positioned to sense the temperature of one of the machine components at a desirable location. Preferably, the heat sensor is located to sense the temperature of the support bar 20, When this sensor 56 detects component temperature below a desired level, for example, below 200° F., it causes a valve 41 to supply steam to the heat exchanger 39, adding heat to the continuously circulating heat exchange medium. When the desired temperature level of the support bar 20 is sensed, the supply of steam to the heat exchanger 39 is discontinued or reduced. In the meantime, the fluid heat exchange medium continues to circulate in the normal manner, maintaining a constant and substantially uniform heat input to the heated components, minimizing both the rate and the extent of any temperature cycling. During operation of the equipment, heat is constantly being extracted from the equipment by reason of the passage of moist fabric through the compacting station, so a constant heat input is necessary during normal operations.

After flowing through the support bar 20, some heat has been extracted from the heat exchange medium. Accordingly, when the temperature of the support bar 20 is controlled to be held at a selected temperature (depending upon the fabric being processed and the results being sought), the temperature of the feed roller 11 derived from the series passage of the liquid exiting from the support bar 20 is typically a few degrees lower than the selected temperature. Further heat is extracted from the medium in passing through the feed roll, and under the conditions mentioned above, typical operating temperatures for the lower tubular element 29 are a few degrees lower than for the feed roller. Importantly, such temperature variations as may be experienced at the sensing point 56 will be reflected in turn in corresponding variations in the temperature of the feed roller and in the lower shoe assembly, enabling the precisely adjusted relationships of the working components to be maintained with the highest degree of constancy and uniformity.

In a preferred embodiment of the invention, control of the steam supply to the heat exchange unit 39 is performed as a function of component temperature through a programmable logic device 60. The logic device 60 receives input from the component temperature sensor 56, sensing the temperature of the upper shoe support bar 20. The output of the logic device 60 can be used to open and close (or to adjustably throttle) the steam valve 41. This arrangement allows for the water to be heated to higher temperatures during warm up periods, for example, for rapid warm up of the system. As the temperature of the component approaches the desired preset level, the temperature at which the liquid heat exchange medium is maintained can be correspondingly reduced to optimize the maintenance of steady state conditions.

Desirably, steam supplied to the valve 41 and heat exchanger 39 is first reduced in pressure from normal plant levels, which typically may maintain the steam at temperatures as high as 300° F. By reducing the pressure to a level at which the steam temperature is a predetermined number of degrees higher than the maximum desired temperature of the liquid heat exchange medium, the opportunity for excessive heating of the liquid medium is minimized, and it becomes easier to maintain steady state conditions.

In a typical and advantageous embodiment of the invention, temperatures of the liquid heat exchange medium could be raised to as much as 230° F., to maintain a desired rate of heating of the machine components, particularly during warm up periods. Using pure water as a heat exchange medium, the system would have to be constructed to withstand internal pressures of perhaps 40 to 50 psi, which can significantly stress certain components of the system, particularly rotary joints, for example. The use of oil as a heat exchange medium minimizes this problem, but creates a whole set of different problems. In a preferred embodiment of this invention, the heating medium is a mixture of water and propylene glycol alcohol (commonly used an anti-freeze solution). A mixture of 70% water, 30% PGA substantially raises the boiling point of the mixture and enables the mixture to be heated to the necessary temperatures at system pressures in the range of 15–30 psi, which are much more manageable in the context of the type of equipment being utilized.

Desirably, the programmable logic unit 60 can be employed to provide for certain safety procedures and operating limits. In the illustrated system, a pressure switch 62 is installed to sense the pressure of the heat exchange medium flowing in the system. If the pressure becomes either too low or too high, a malfunction is indicated and an appropriate response can be taken or signalled via the logic unit 60. Likewise, startup of the rollers 11, 22 can be prevented until an appropriate temperature is indicated by the sensor 56, so that neither the equipment nor the processed fabric will be deleteriously affected by a premature startup.

Significant advantages are derived from use of the system of the invention in connection with mechanical compressive shrinkage equipment. By eliminating multiple heat devices, such as the use of steam or liquid for certain components and electrical elements for other components, a much higher degree of uniformity and consistency in the heating of the several critical components of the apparatus is assured. In particular, the use of a single, constantly flowing heated liquid, which is caused to flow in series through all of the multiple components requiring external heat provides important advantages. The remotely heated, flowing liquid medium provides a substantially more constant and uniform source of heat than, for example, cycling electrical elements, steam or the like. In addition, the circulation of the heat exchange medium in series through all of the multiple components requiring heat input assures that, regardless of such variations as there may be in the temperature of the fluid medium, those variations will be reflected in all of the heated components and the temperature relationships of one component to the other will be more closely maintained.

The system of the invention provides for particularly rapid and efficient warm up time for starting up the equipment from cold condition, and provides for a highly uniform level of heat across the full width of the components. Continuous and uniform heating of the machine is also assured when the equipment is stopped, because the heating medium remains in continuous circulation in series through the heated components of the machine.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A heating system for a mechanical compressive shrinkage machine for lengthwise compressive shrinkage of fabrics, where said machine includes a rotating feed roller and a shoe assembly cooperating with said feed roller, which comprises (a) a supply of liquid heating medium, (b) means for continuously circulating said medium, (b) a heat exchange device associated with said circulating medium for heating said medium to an elevated temperature, (c) duct means for directing said heating medium from said heat exchange device to said shoe assembly and said feed roller, from one to the other in series.

2. A heating system according to claim 1, further including (a) means for sensing the temperature of an element of said machine receiving heat from said circulating medium, and (b) means for controlling heat supplied by said heat exchanger in accordance with the sensed temperature of said element.

3. A heating system according to claim 1, wherein (a) said duct means is arranged to circulated heated medium first through said shoe assembly and then through said feed roller.

4. A heating system according to claim 1, wherein (a) said machine includes a second shoe assembly, and (b) said duct means is arranged to direct heated medium through said second shoe assembly in series relation with the first-mentioned shoe assembly and said feed roller.

5. A heating system according to claim 4, wherein (a) said duct means is arranged to direct heated medium in series through said first mentioned shoe assembly, then said feed roller, and then said second shoe assembly, (b) means are provided for sensing the temperature of one of shoe assemblies or feed roller, and (c) means are provided for controlling the operation of said heat exchange device in accordance with temperatures sensed by said sensing means.

6. A heating system according to claim 1, wherein (a) said liquid heating medium is a mixture of water and propylene glycol alcohol.

7. A heating system according to claim 6; wherein (a) said liquid heating medium is a mixture of approximately 70% water and approximately 30% propylene glycol alcohol.

8. A heating system according to claim 2, wherein (a) said liquid heating medium is a mixture of water and at least about 30% propylene glycol alcohol, and (b) said sensing and controlling means are arranged to maintain the temperature of said element at least about 200°.

* * * * *